US006572435B1

(12) United States Patent
Wong

(10) Patent No.: US 6,572,435 B1
(45) Date of Patent: Jun. 3, 2003

(54) CONTROLLABLE CONFETTI LAUNCHER

(75) Inventor: Paul Wong, Kwai Cheung (CN)

(73) Assignee: Mingway Industrial, Limited, Hong Kong (CN)

( * ) Notice: Subject to any disclaimer, the term of this patent is extended or adjusted under 35 U.S.C. 154(b) by 0 days.

(21) Appl. No.: 10/246,385

(22) Filed: Sep. 18, 2002

(51) Int. Cl.[7] ..... A63H 33/00

(52) U.S. Cl. ..... 446/475; 446/486; 124/16; 124/37

(58) Field of Search ..... 446/475, 486, 446/308, 309, 310, 311; 472/52, 54; 124/16, 37

(56) References Cited

U.S. PATENT DOCUMENTS 3,581,434 A * 6/1971 Fels ..... 446/309
4,033,529 A * 7/1977 Bourgeois ..... 244/151 B
5,117,995 A * 6/1992 Kau ..... 215/228
5,120,263 A * 6/1992 Ierfino et al. ..... 446/486
5,664,551 A * 9/1997 Spector ..... 124/16

FOREIGN PATENT DOCUMENTS

DE 4037282 A1 * 5/1992 ..... B65D/39/00

* cited by examiner

*Primary Examiner*—Derris H. Banks
*Assistant Examiner*—Urszula M Cegielnik
(74) *Attorney, Agent, or Firm*—Darby & Darby

(57) ABSTRACT

A confetti launcher is provided and includes a housing for storing the confetti, a rotatable actuator coupled to the housing, and a spring biased movable member disposed within an interior of the housing for ejecting the confetti. The movable member is positionable between a first position where it is locked relative to the actuator and a second position where it is free to move and an energy stored in a biasing element is released and translated into a force applied to the stored confetti such that the confetti is ejected from an open end of the housing.

18 Claims, 2 Drawing Sheets

CONTROLLABLE CONFETTI LAUNCHER

TECHNICAL FIELD

This invention concerns a device for launching confetti, novelty items, and the like, and more particularly, to a small, compact confetti launcher which is safe to operate and can be used by the general public.

BACKGROUND

A number of different devices for launching confetti have been disclosed in the prior art.

Most of these launching devices are of the type that are powered by compressed gas such that the confetti, novelty items or other types of items held within a canister (housing) are propelled by igniting a chemical based substance located at a base of the canister. The chemical based substance expands forcing a movable portion, whereupon, the confetti or the like is ejected out of the canister. Unfortunately, one of the disadvantages of these types of confetti launchers is due to the fact that they are gas based systems. More specifically, the actuation of the device can produce an uncontrolled and uncontrollable discharge of gas toward the user or other persons standing nearby. This can result in the user or other person(s) experiencing facial discomfort if the compressed gas is discharged into the user's face, especially eye regions. Further, the discharged gas can carry foreign particles and the like which can be launched into the eyes or onto a person's face. These foreign particles at least cause irritation of the eyes and in some instances can even result in an injury. It is also possible that the compressed gas can leak thereby rendering the device essentially useless since the confetti is unable to be launched without the gas propellant.

Thus, it would be desirable to develop a safer alternative confetti launcher in comparison to the ones that are powered by compressed gas.

SUMMARY

A confetti launcher is provided and includes a housing for storing the confetti, a rotatable actuator coupled to the housing, and a spring biased movable member disposed within an interior of the housing for ejecting the confetti. The movable member is positionable between a first position where it is locked relative to the actuator and a second position where it is free to move and energy stored in a biasing element that biases the movable member is released and translated into a force applied to the stored confetti such that the confetti is ejected from an open end of the housing.

In one exemplary embodiment, the actuator has a key feature formed as a part thereof and the movable member includes a complementary locking feature that is formed as a part thereof. The key feature is received within the locking feature and then arranged into a locked position so as to restrict the movement of the movable member relative to the actuator. When the user desires for the confetti to be discharged, the user rotates the actuator relative to the housing while the movable member is disposed in the housing such that it can not rotate relative thereto. The actuator is rotated until registration between the key feature and the locking feature is achieved. The registration between the two features releases the stored biasing energy and this is translated into the movable member being displaced away from the actuator. The displacement of the movable member applies a force to the confetti and results in the confetti being ejected from the housing.

By substituting the conventional gas cartridge actuating system with an actuating system that is based on a biasing element (e.g., a spring), a number of advantages are realized. First, the present design is simpler because it does not require values or other structures to ensure separation of the various materials that react with one another to produce the gas. Second, the present design eliminates all safety concerns that are associated with a compressed gas system since the present launcher is devoid of any stored gas or combustible materials for forming gas.

The above, and other objects, features and advantages of the present device will become apparent from the following description read in conjunction with the accompanying drawings, in which like reference numerals designate the same elements.

BRIEF DESCRIPTION OF THE DRAWING FIGURES

DETAILED DESCRIPTION OF PREFERRED EMBODIMENTS

Figure 1:
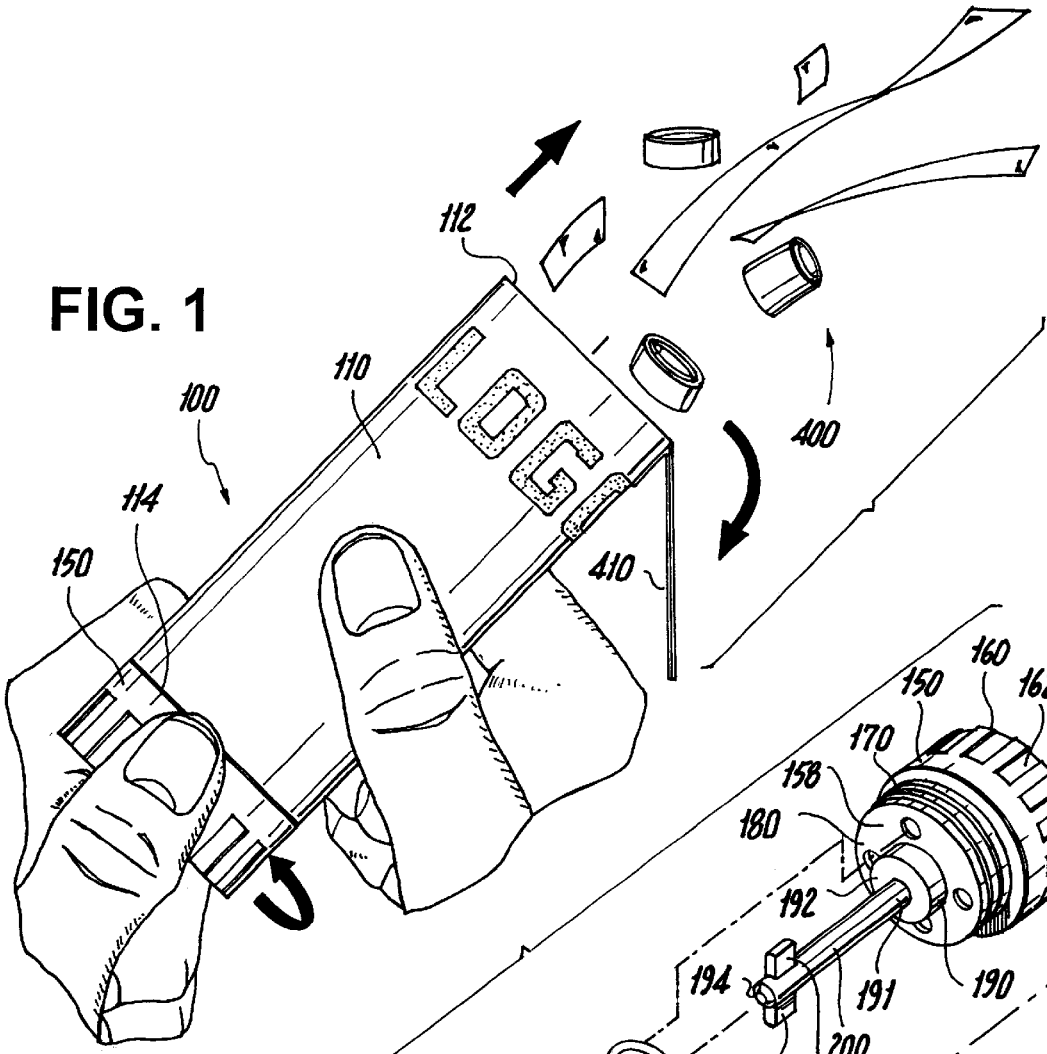
FIG. 1 is perspective view of a confetti launcher according to a first embodiment after the launcher has been activated, thereby launching the confetti.
Figure 2:
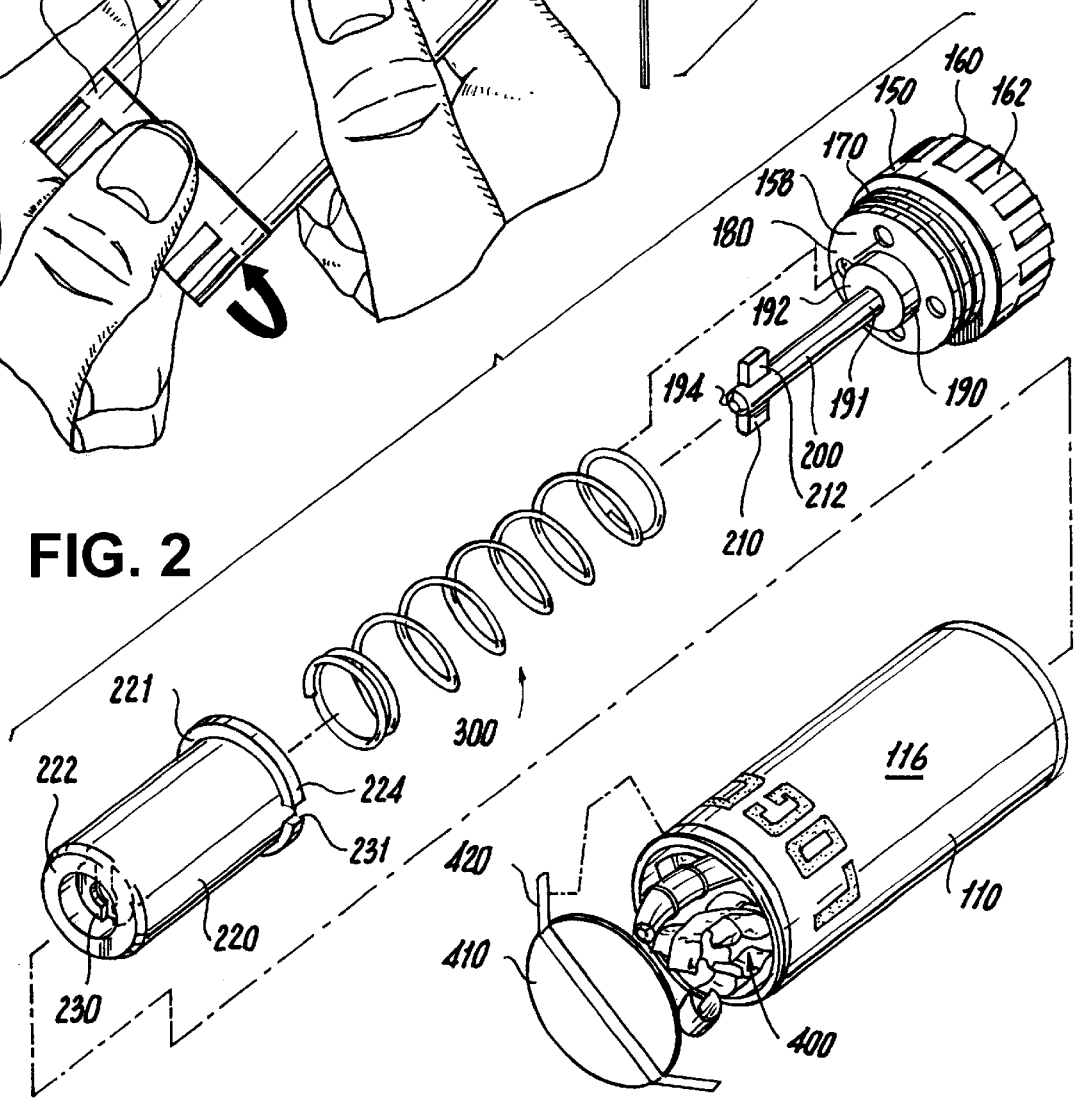
FIG. 2 is a front exploded view of the confetti launcher of FIG. 1.
Figure 3:
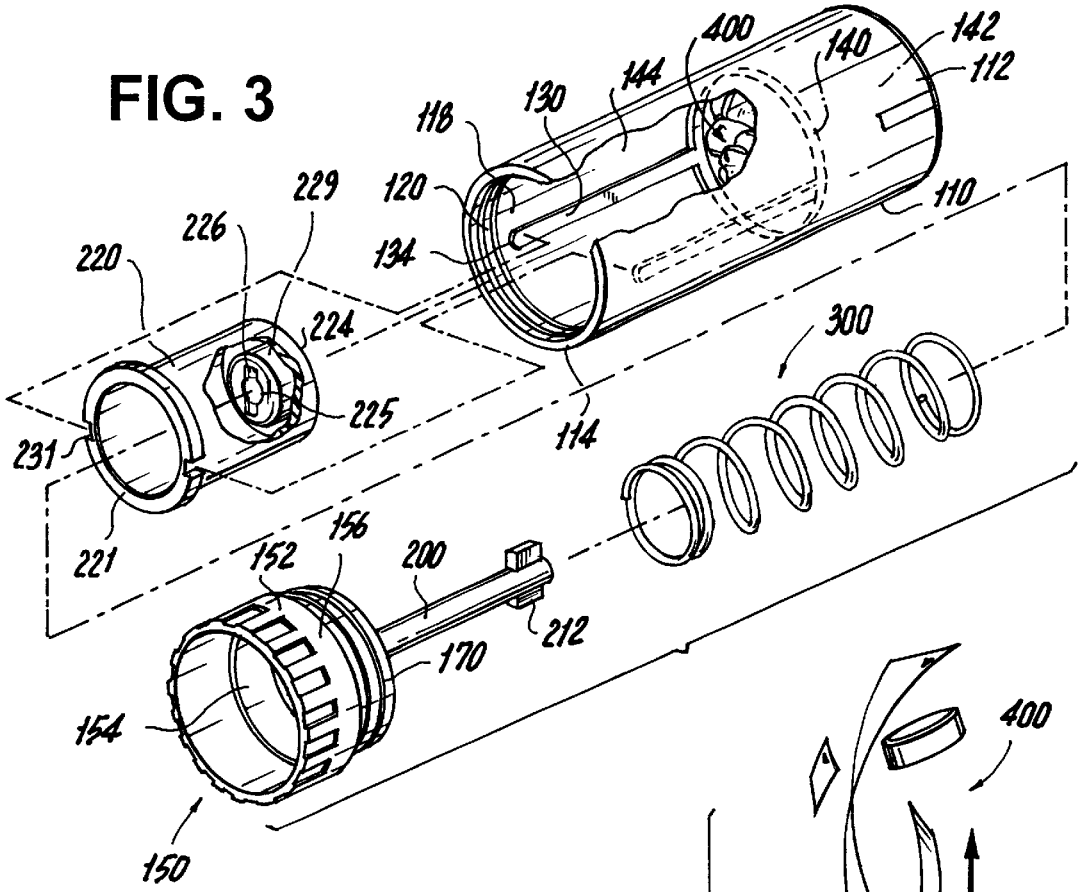
FIG. 3 is a rear exploded view of the confetti launcher of FIG. 1.
Figure 4:
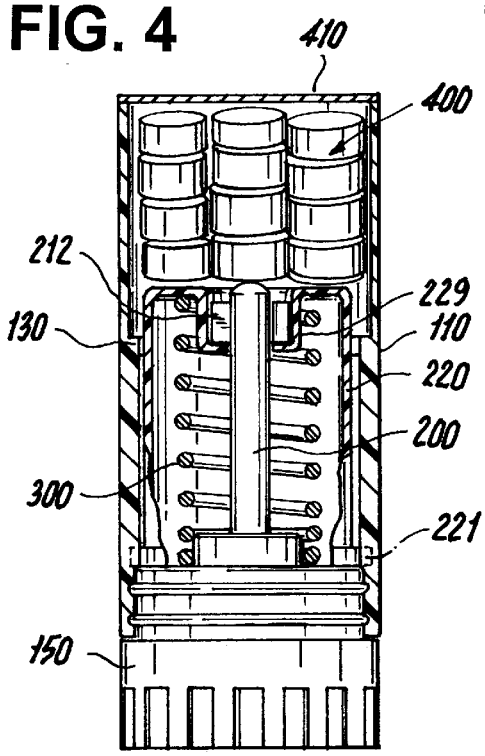
FIG. 4 is a cross-sectional view of the confetti launcher of FIG. 1 prior to the activation thereof.
Figure 5:
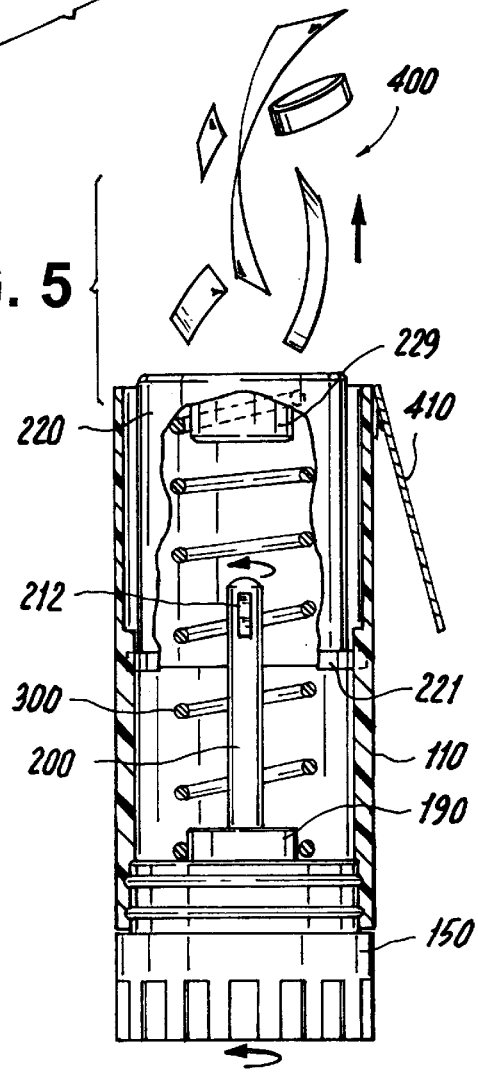
FIG. 5 is a cross-sectional view of the confetti launcher of FIG. 1 in the activated position.

Referring to FIGS. 1–5, a confetti launcher 100 according to a first embodiment is provided. The confetti launcher 100 is generally formed of a canister (housing) 110 that has an open first end 112 and an open second end 114. The canister 110 preferably has an annular shape such that it is in the form of a tubular element; however, the canister 110 can come in any number of shapes and sizes depending upon the particular application. The canister 110 has an outer surface 116 on which indicia can be disposed. For example, a product label (not shown) or the like can be disposed on the outer surface 116 and instructions for use are typically supplied as a part of this label.

The canister 110 also includes an inner surface 118. The inner surface 118 includes a number of features that are designed to cooperate with other components during the actuation of the launcher 100 as will be described in greater detail hereinafter. More specifically, the inner surface 118 includes threads 120 formed at or near the second end 114 of the canister 110. The exemplary threads 120 are circular in nature due to the annular shape of the canister 110 and the number of threads 120 can vary depending upon the configuration of some of the other complementary components.

The inner surface 118 also includes a pair of opposed raised rails 130 that are formed thereon. According to one exemplary embodiment, the raised rails 130 are formed about 180° apart from one another. Each rail 130 has a first end 132 and an opposing second end 134 that faces and is disposed near the threads 120 in spaced relationship therefrom. The first end 132 intersects and is integrally formed with a stop 140. According to one embodiment, the stop 140 is a raised ring that is formed on the inner surface 118. The raised ring partitions the canister 110 into a first section 142 and a second section 144 with the first section 142 being formed above the stop 140 to the first end 112 of the canister 110 and the second section 144 being formed below the stop 140 to the second end 114. In one exemplary embodiment, the first section 142 occupies less area than the second section 144. The canister 110 can be formed of a number of different materials, including plastic materials (e.g., moldable plastics).

The confetti launcher 100 also includes a rotatable actuator 150 that is a substantially hollow member having a body 152 that defines an inner cavity 154 and has an outer surface 156. The rotatable actuator 150 has a first end 158 and an opposing second end 160. The rotatable actuator 150 has a stepped configuration in that a shoulder 162 is formed between the first and second ends 158, 160 with the section lying below the shoulder 162 having a greater dimension (e.g., greater diameter) than a section that lies above the shoulder 162. The section that lies above the shoulder 162 has threads 170 formed thereon for mating with the complementary threads 120 formed as part of the canister 110 so as to couple the two components together in a rotational manner. As with the threads 120, the threads 170 have an annular shape (i.e., ring-like shape).

Formed on the outer surface 156 at or near the second end 160 is a series of slightly raised ribs 162 that serve as a gripping surface for the user to make it easier to hold and rotate the actuator 150 once it is coupled to the canister 110. Just above the threads 170, a first planar platform 180 is formed and a protrusion (e.g., a nub) 190 is formed on the first planar platform 180 and extends therefrom. As with the other features, the protrusion 190 has a circular shape according to one exemplary embodiment and defines a second planar platform 192. A diameter of the protrusion 190 is significantly less than a diameter of the first planar platform 180. A post 200 is attached to the second planar platform 192 and extends outwardly therefrom. The post 200 is preferably integrally formed with the protrusion 190 at one end 191 thereof, while the other opposing end 194 includes a key feature 210.

According to one exemplary embodiment, the post 200 has an annular shape and the key feature 210 is formed of a pair of opposing protrusions 212 that extend outwardly from the post 200. Each protrusion 212 is a square shaped member that extends outwardly from the post 200 and in one exemplary embodiment, the protrusions 212 are arranged opposite one another (i.e., 180° apart from one another).

It will be appreciated that the rotatable actuator 150 does not necessarily have to be a hollow member; however, the hollow nature of the rotatable actuator 150 reduces manufacturing cost and increases the ease of manufacturing when the rotatable actuator 150 is a plastic member formed as a result of a molding operation.

The confetti launcher 100 also includes a movable guide sleeve 220 that has a first end 222 and an opposing second end 224. The guide sleeve 220 is a hollow member or contains a passage that extends from the first end 222 to the second end 224 to permit reception of the post 200. More specifically, near the first end 222 of the guide sleeve 220, a locking feature 230 is formed to selectively mate with the key feature 210 so as to position and lock the guide sleeve 220 relative to the rotatable actuator 150. One exemplary locking feature 230 is in the form of a wall that extends across the guide sleeve 220, and the wall includes a circular center opening 225 and extending outwardly therefrom are a pair of locking slots 226. The locking feature 230 is not formed at the end of the guide sleeve 220 but rather is spaced therefrom and therefore, the wall is part of a protrusion 229, as viewed from an underside of the guide sleeve 220, that extends downwardly toward the second end 224. This protrusion 229 is also generally annular in shape.

A biasing element 300 is disposed between the guide sleeve 220 and the actuator 150 and more specifically, the biasing element 300 is disposed such that one end of the biasing element 300 is disposed around the protrusion 229 and the other end of the biasing element 300 is disposed around the protrusion 190. One exemplary biasing element 300 is a spring with ends that wrap around both protrusions 190, 229 and the post 200 extends between the coils of the spring. The dimensions of the locking protrusions 212 are such that these members do not interfere with the spring when the spring is in a relaxed position, a compressed position, or a position therebetween.

The locking feature 230 is complementary to the key feature 210 such that the post 200 is received through the center opening 225 and the protrusions 212 are received through the locking slots 226 when the post 200 is in proper alignment (registration) with the guide sleeve 220. More specifically, the actuator 150 is rotated until the protrusions 212 are in registration with the locking slots 226 and the movable guide sleeve 220 is locked relative to the actuator 150 by compressing the biasing element (thereby storing energy therein) until the post 200 and locking protrusions 212 pass through the center opening 225 and the locking slots 226, respectively. Once the post 200 passes through and the locking protrusions 212 clear the locking slots 226, the actuator 150 is rotated a certain amount to cause the locking protrusions 212 to no longer be in registration with the locking slots 226. Once the protrusions 212 are no longer in registration with the locking slots 226, an interference fit is formed between the actuator 150 (i.e., the protrusions 212 thereof) and the movable guide sleeve 220 and the guide sleeve 220 is locked into position with the biasing element 300 being in a compressed state.

The guide sleeve 220 has an annular lip 221 formed at the second end 224 thereof and further includes a pair of guide slots or detents 231 formed in the lip 221. The detents 231 are formed in positions that are complementary to the raised rails 130 such that when the guide sleeve 220 is disposed within the canister 110, the raised rails 130 are disposed within the detents 231. The raised rails 130 thus serve to locate and retain the guide sleeve 220 and restrict the movement thereof. In other words, the raised rails 130 serve as guide rails to control the movement of the guide sleeve 220 within the canister 110. The guide sleeve 220 travels along the raised rails 130 during insertion of the guide sleeve 220 into the canister 110 as during manufacturing and also during release of the stored energy of the biasing element 300 when the user causes the discharge of the confetti 400 in the manner described below.

The stop 140 serves to limit the movement of the guide sleeve 150 due to the interaction between the lip 221 of the guide sleeve 150 and the stop 140. Once the lip 221 contacts the stop 140, the movement of the guide sleeve 220 in a direction toward the first end 112 of the canister 110 is curtailed and the guide sleeve 220 is prevented from being discharged from the canister 110 itself.

The assembly and operation of the confetti launcher 100 will now be described. The actuating elements of the launcher 100 are assembled by disposing the biasing element 300 about the protrusion 190 and then about the protrusion 229. The guide sleeve 220 is then directed toward the rotatable actuator 150, thereby causing the biasing element 300 to become compressed (store energy). As the biasing element 300 is compressed, the key feature 210 is brought into registration with the locking feature 210 so that the locking protrusions 212 are received within the locking slots 226 until they clear the wall and then the actuator 150 is rotated to cause an interference fit between the locking protrusions 212 and the guide sleeve 220.

The acuator assembly is disposed within the second end 114 of the canister 110 so that the guide rails 130 are received within the detents 231 and the threads 170 intermesh with the threads 120 that are formed as part of the canister 110. The intermeshing of the threads 120, 170 serves to securely couple the rotatable actuator 150 to the canister 110. The guide rails 130 locate and position the actuator assembly within the canister 110 in such a manner that the guide sleeve 220 is prevented from rotating within the canister 110, while at the same time, the rotatable actuator 150 is free to rotate relative to the canister 110.

Confetti 400 is stored within the canister 110 in the first section 142 thereof above the locked guide sleeve 220. The first end 112 of the canister 110 is closed by a releasable member 410 that opens when the user actuates the launcher 100. In one exemplary embodiment, the releasable member 410 is a cardboard disk that is attached to the canister 110 using a thin adhesive strip 420 that extends across the disk 410. One end of the adhesive strip 420 is arranged so that it will release from the canister 110 when the user actuates the launcher 100 in the following manner, thereby freeing the confetti 400 to be discharged.

To actuate the launcher 100 and discharge the confetti 400, the user simply grasps the canister 110 in one hand and grasps the rotatable actuator 150 in the other hand. The user then begins to rotate the actuator 150 until the locking protrusions 212 come into registration with the locking slots 226. As soon as this registration occurs, the guide sleeve 220 is no longer locked and the stored energy of the biasing element 300 is released causing the guide sleeve 220 to be propelled along the raised rails 130 until the lip 221 strikes the stop 140. As the guide sleeve 220 is propelled, the volume of the first section 142 where the confetti 400 is stored becomes less and less and the stored confetti 400 is therefore compressed and applies a force against the releasable member 410. This applied force effectively dislodges the releasable member 410 from its closed position, thereby opening the cavity that stores the confetti 400. The confetti 400 is then discharged under force as a result of the release of the energy stored in the biasing element 300.

The confetti 400 can be in any number of different forms that are traditionally used with confetti launchers, confetti cannon or similar type devices. For example, one type of confetti 400 is formed of metallic foil or it can be formed of paper, etc. The confetti 400 can be cut into small pieces or it can be in the form of longer strips or it can be in the form of confetti streamers (i.e., rolls of confetti material that unwrap as they are discharged).

By substituting the conventional gas cartridge actuating system with an actuating system that is based on a biasing element (e.g., a spring), a number of advantages are realized. First, the present design is simpler because it does not require values or other structures to ensure separation of the various materials that react with one another to produce the gas. Second, the present design eliminates all safety concerns that are associated with a compressed gas system since the present launcher is devoid of any stored gas or combustible materials for forming gas. While, the present device offers a safer alternative to compressed gas based systems, the enjoyment value of the present device is not jeopardized since the present launcher 100 is constructed to discharge confetti in the air.

While the present launcher 100 has been described in terms of discharging confetti, it will be appreciated that other items, such as novelty items, can be disposed within the canister 110 assuming that the items fit within the canister 110 and can be discharged as a result of the force generated by the actuating element (e.g., rotatable actuator 150).

While the invention has been particularly shown and described with reference to preferred embodiments therefore, it will be understood by those skilled in the art the various changes in form and detail can be made without departing from the spirit and scope of the invention.

What is claimed is:

1. A confetti launcher comprising:

a housing for storing the confetti;

a rotatable actuator coupled to the housing;

a movable member disposed within an interior of the housing for ejecting the confetti, the movable member being positionable between a first position where it is locked relative to the actuator and a second position where it is free to move, wherein rotation of the actuator causes the movable member to go from the first locked position to the second unlocked position and the movable member applies a force to the stored confetti such that the confetti is ejected from an open end of the housing.

2. A confetti launcher comprising:

a housing for storing the confetti;

a rotatable actuator coupled to the housing;

a movable member disposed within an interior of the housing for ejecting the confetti, the movable member being positionable between a first position where it is locked relative to the actuator and a second position where it is free to move; and a biasing element disposed between the movable member and the actuator, wherein the biasing element stores energy when the movable member is in the first locked position, wherein rotation of the actuator causes the movable member to go from the first locked position to the second unlocked position where the movable member applies a force to the stored confetti such that the confetti is ejected from an open end of the housing.

3. The confetti launcher of claim 2, wherein the housing is a tubular canister.

4. The confetti launcher of claim 2, wherein the housing has at least one guide rail formed on an inner surface thereof for guiding the movable member between the first and second positions.

5. The confetti launcher of claim 4, wherein the housing includes a stop formed on the inner surface for contacting a lip formed at one end of the movable member to restrict movement of the movable member.

6. The confetti launcher of claim 5, wherein the lip includes at least one detent formed therein for receiving the at least one guide rail so as to permit longitudinal movement of the movable member while preventing rotation thereof.

7. The confetti launcher of claim 2, wherein the actuator includes threads formed on an outer surface for mating with threads formed on an inner surface of the housing so as to rotatingly couple the actuator to the housing.

8. The confetti launcher of claim 2, wherein the actuator includes a post having a key feature as part thereof, the key feature interlockingly mating with a locking feature formed as part of the movable member, wherein rotation of the actuator releases the movable member from its locked position when registration between the key and locking features is achieved.

9. The confetti launcher of claim 8, wherein the key feature comprises at least one tab extending outwardly from the post and the locking feature comprises a platform extending across the movable member that includes a center opening and at least one side slot extending outwardly from the center opening.

10. The confetti launcher of claim 9, wherein the at least one tab comprises a pair of opposing tabs.

11. The confetti launcher of claim 9, wherein the center opening is shaped to receive the post and the at least one slot is shaped to receive the at least one tab.

12. The confetti launcher of claim 9, wherein one end of the post is integrally formed with a first raised platform formed as part of the actuator and the biasing element comprises a spring in which one end thereof is disposed around the first raised platform.

13. The confetti launcher of claim 2, wherein the housing includes a first feature that mates with a second feature formed as part of the movable member to prevent rotation of the movable member within the housing, while permitting longitudinal movement of the movable member along a length of the housing.

14. The confetti launcher of claim 13, wherein the first feature comprises a stop for preventing longitudinal movement of the movable member beyond the stop and at least one guide rail for guiding the movable member in a longitudinal direction along a length of the housing.

15. The confetti launcher of claim 2, wherein each of the movable member and the actuator comprises a substantially hollow member.

16. The confetti launcher of claim 2, further including a releasable member releasably attached to one end of the housing, wherein the releasable member is at least partially dislodged from the housing when the force is applied to the confetti to permit the confetti to be ejected.

17. The confetti launcher of claim 16, wherein the releasable member comprises a cardboard disk.

18. A confetti launcher comprising:

a housing for storing the confetti;

a rotatable actuator coupled to the housing; and a spring biased movable member disposed within an interior of the housing for ejecting the confetti, the movable member being positionable between a first position where it is locked relative to the actuator and a second position where it is free to move and stored biasing energy is released and translated into a force applied to the stored confetti such that the confetti is ejected from an open end of the housing.

* * * * *